United States Patent [19]

Pinkerton

[11] Patent Number: 4,741,464

[45] Date of Patent: May 3, 1988

[54] MULTIPLE ORIFICE NOZZLE FOR JET CASTING RAPIDLY SOLIDIFIED MOLTEN METAL

[75] Inventor: Frederick E. Pinkerton, Sterling Heights, Mich.

[73] Assignee: General Motors Corporation, Detroit, Mich.

[21] Appl. No.: 866,257

[22] Filed: May 23, 1986

[51] Int. Cl.[4] ..... B22D 11/10

[52] U.S. Cl. ..... 222/598; 164/437; 222/485; 222/603

[58] Field of Search ..... 164/335, 337, 437; 222/598, 597, 602, 603, 485

[56] References Cited

U.S. PATENT DOCUMENTS 350,675 10/1886 Hathaway ..... 222/485
3,377,006 4/1968 Bahm ..... 222/598
3,386,633 6/1968 Nadrich et al. ..... 222/598
4,546,815 10/1985 Liebermann et al. ..... 164/437 X

FOREIGN PATENT DOCUMENTS 56-148452 11/1981 Japan ..... 222/603
724158 2/1955 United Kingdom ..... 222/598

*Primary Examiner*—M. Jordan
*Assistant Examiner*—J. Reed Batten, Jr.
*Attorney, Agent, or Firm*—Elizabeth F. Harasek

[57] ABSTRACT

A stopper rod which has a plug at one end fits snugly into the inside of the nozzle having multiple ejection orifices. The plug is provided with at least one slot or opening which can be located directly over a selected orifice to allow passage of molten metal therethrough. When erosion occurs, the plug is indexed to locate the opening over a different, uneroded orifice.

3 Claims, 2 Drawing Sheets

MULTIPLE ORIFICE NOZZLE FOR JET CASTING RAPIDLY SOLIDIFIED MOLTEN METAL

This invention relates to a multiple orifice nozzle for jet casting molten metal. The use of the multiple orifice nozzle in conjunction with a specially adapted stopper rod extends the continuous operation time for a jet casting apparatus.

BACKGROUND OF THE INVENTION

Certain rare earth-transition metal containing alloys can be made permanently magnetic by quenching in a very finely crystalline microstructure. One method of doing this is to eject a fine stream of molten alloy through a small orifice and quench the stream on a rapidly moving chill surface such as the perimeter of a rotating metal quench wheel. This process is known as melt spinning or jet casting. These terms may be used interchangeably herein to refer to such rapid solidification processes. Methods of making rare earth-iron (RE-Fe) based permanent magnets using melt spinning techniques are set forth in U.S. Pat. No. 4,495,396, U.S. Ser. No. 414,936 filed Sept. 3, 1982 and U.S. Ser. No. 544,728 filed Oct. 26, 1983 to Croat assigned to the assignee hereof, for example.

One problem encountered in jet casting is the erosion of the orifice through which the molten metal is expressed. As the orifice erodes, a greater amount of metal passes through it. Eventually, the metal flows too quickly to be quenched rapidly enough to achieve a desired amorphous to very finely crystalline microstructure.

SUMMARY OF THE INVENTION

In accordance with a preferred practice of this invention, a nozzle for jet casting molten metal, particularly rare earth-transition metal-boron alloys, is provided with multiple ejection orifices. A stopper rod is provided which has a plug at pne end which fits snugly into the inside of the nozzle. The plug is provided with at least one slot or opening which can be located directly over a selected orifice to allow passage of molten metal therethrough while preventing passage of molten metal through other orifices.

When erosion of the open orifice would otherwise require cessation of jet casting and change of nozzle, this invention provides for indexing the plug to locate the slot over a different orifice.

The plug may be additionally provided with a hole through which a fluid or a hot gas may be forced to clear a plugged orifice and thereby further extend the useful life of an ejection nozzle.

The invention will be better understood in view of the figures and a detailed description of a preferred embodiment which follow.

DETAILED DESCRIPTION OF THE PREFERRED EMBODIMENTS

Figure 1:
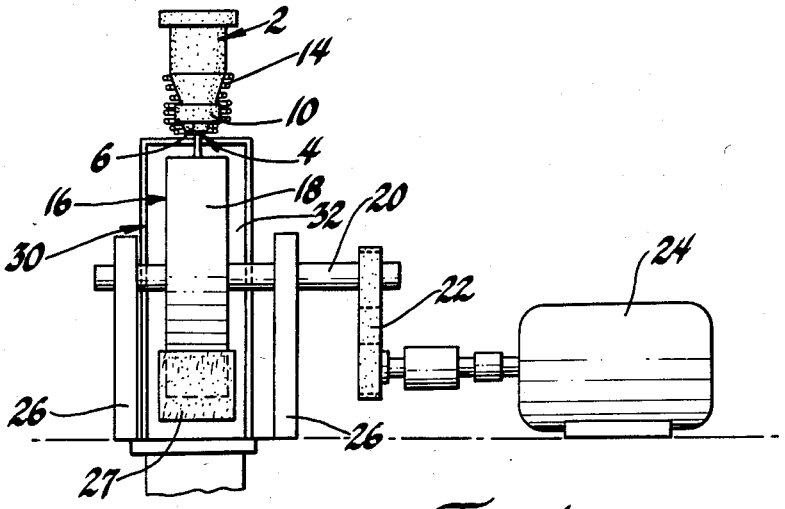
FIG. 1 is a schematic representation of an apparatus for jet casting molten metal onto the perimeter of a spinning quench wheel.
Figure 2:
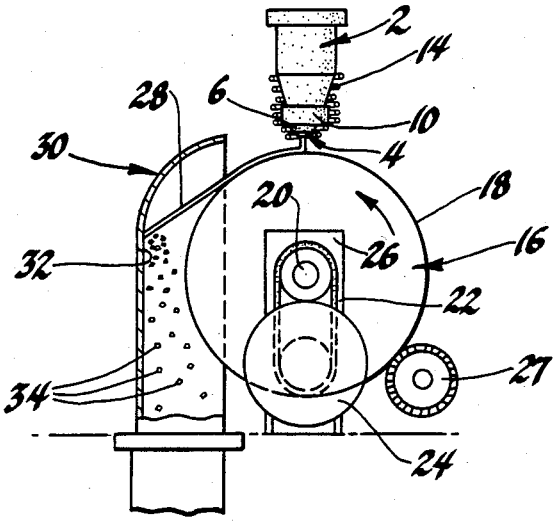
FIG. 2 is a side view of the apparatus of FIG. 1.

FIGS. 1 and 2 show a simplified schematic for a preferred jet casting apparatus. It comprises a refractory crucible 2 for containing the molten metal to be jet cast. A nozzle 4 surrounded by a graphite susceptor 6 is provided at the base of crucible 2. Nozzle 4 and susceptor 6 are held in place by refractory retainer ring 10.

Molten metal in crucible 2 and nozzle 4 is inductively heated by copper induction heating coils 14. Molten metal as ejected from nozzle 4 is impinged on the perimeter 18 of a rotating quench wheel 16. Wheel 16 is turned on shaft 20 by belt 22 coupled to a variable speed drive motor 24. Shaft 20 is spindled in bracket supports 26. Brush 27 may be provided to continuously clean the quench wheel.

As ejected molten metal impinges on quench wheel 16, it solidifies very rapidly forming thin ribbon 28 with a substantially amorphous to very finely crystalline microstructure. Ribbon 28 is collected in bin 30 as it is thrown off the quench wheel. When ribbon 28 is a brittle RE-Fe alloy, it shatters against the back 32 of bin 30 and collects as a coarse powder 34 on the bottom.

Figure 3:
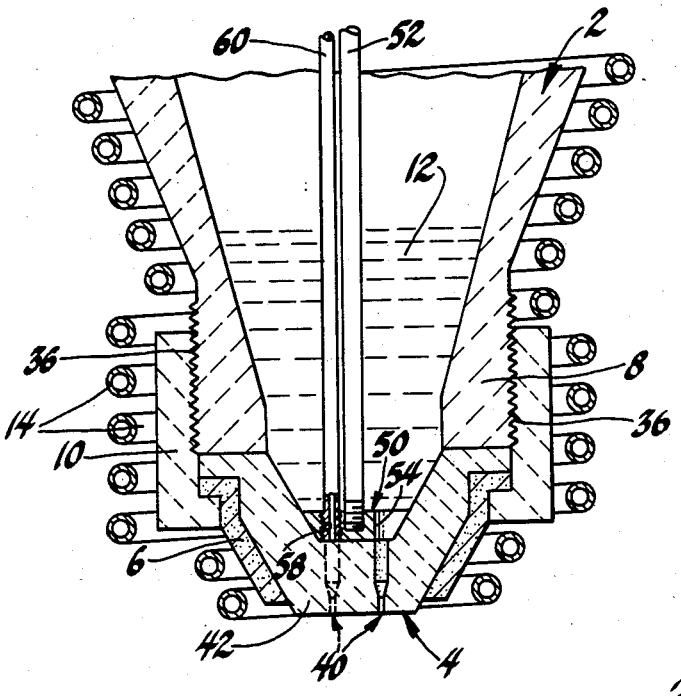
FIG. 3 is a sectional view of a crucible for jet casting metal and having a specially adapted multiple orifice ejection nozzle and complementary stopper rod.
Figure 4:
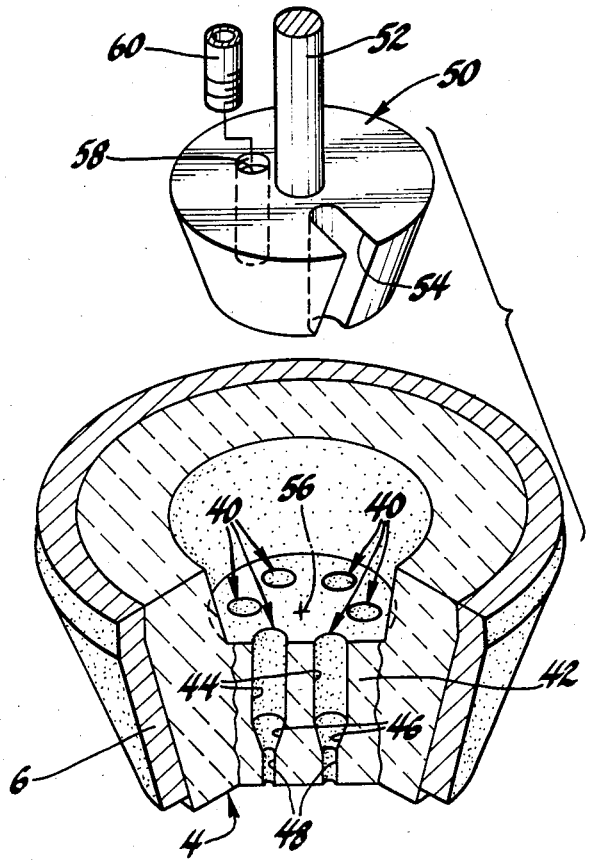
FIG. 4 is an exploded sectional view of a portion of the nozzle, the stopper rod and plug.

FIGS. 3 and 4 show a preferred embodiment of an apparatus in accordance with this invention. Referring to FIG. 3, a portion of a refractory crucible 2 is shown. Ejection nozzle 4 is surrounded by graphite susceptor 6 and press sealed against base 8 of crucible 2 by refractory retainer ring 10. Ring 10 and the lower portion of crucible 2 are threaded 36 so that ring 10 can simply be screwed on and off to change nozzles.

Molten metal 12 in crucible 2 is heated by induction heating coils 14 surrounding them. Susceptor 6 helps heat metal in nozzle 4 since the small amount of metal in the nozzle orifices may not couple sufficiently with heating coils 14 to maintain it in a molten condition. Heat is conducted by graphite susceptor 6 to nozzle 4 keeping it hot enough to prevent cold shuts in the ejection orifice(s). It may be preferable to use several individually controlled coils 14 in different locations outside crucible 2 and nozzle 4 to more carefully control heating of the metal.

Key to this invention is the provision of a plurality of ejection orifices 40 of desired size in the bottom 42 of the right frustoconical-shaped interior of nozzle 4. Optimum flow characteristics have been achieved by providing orifices 40 which are wider at their upper portion 44, have a taper 46, and narrow to a portion 48 having the width of the desired jet stream. When casting RE-Fe magnet alloys, a width of about 0.5–0.8 mm is desirable.

Plug 50 is threadingly retained at the end of control rod 52. Plug 50 is shaped to fit snugly in the bottom 42 of nozzle 4 in a fluid tight sealing relationship. Plug 50 is provided with at least one passage 54, preferably in the form of a notch or orifice at least as large as portion 44 of ejection orifices 40.

In the embodiment of the invention shown, orifices 40 are arrayed concentrically about center 56 of the circular base 42 of nozzle 4. Notch 54 is provided in plug 50 which extends inwardly from the outside edge and has a width which is the same as the diameter of the top portion 44 of each outlet orifice 40. The orifices 40 are spaced far enough apart so that notch 54 can be rotated to fall between two orifices 40 to completely cut off metal flow.

An additional hole 58 is provided in plug 50 which is threadingly sealed to hollow tube 60. Hole 58 is preferably positioned so that it is not over an orifice 40 when notch 54 is and vice versa. When an orifice 40 becomes plugged with slag or some other material, plug 50 can be rotated to position hole 58 over it. A hot gas or fluid can be forced through hollow rod 60 and hole 58 to clear the plugged orifice.

When operating a jet caster, plug 50 is securely seated in nozzle 4. The plug is rotated so that slot 54 is located directly over an orifice 40. Molten metal 12 is ejected through the orifice and quenched to make amorphous to finely crystalline alloy ribbon.

As jet casting continues, the orifice wears and its size increases. Eventually, the orifice becomes so large that alloy ejected through it cannot be quenched quickly enough to obtain the desired microstructures. At such time, plug 50 is simply rotated in nozzle 4 so slot 54 is indexed over a different orifice. Since it is not necessary to change the nozzle each time an orifice erodes, the time during which a jet caster can be operated continuously is greatly improved over conventional single-orifice equipment.

It is also possible to provide a plurality of notches in the plug so that metal can be cast simultaneously through a plurality of orifices while other orifices are blocked.

When casting RE-Fe alloys, boron nitride is a preferred nozzle material and boron nitride and yttria oxide are preferred materials for the crucible. The control rod and hollow tube may be made of tantalum or some other tough metal or alloy resistant to attack by molten rare earth metals. The plug may be made of a similar metal or a refractory material such as boron nitride. When machining the several components, the coefficients of thermal expansion of each should be taken into consideration so that the parts fit at elevated jet casting temperatures.

While my invention has been described in terms of specific embodiments thereof, other forms may be readily adapted by one skilled in the art. Therefore, the scope of the invention is to be limited only in accordance with the scope of the following claims.

The embodiments of the invention in which an exclusive property or privilege is claimed are defined as follows:

1. An apparatus for jet casting molten metal comprising a crucible for retaining said metal, a nozzle at the base of said crucible having a plurality of ejection orifices therethrough, a plug which is shaped to be sealingly and movably engaged with the upstream side of said nozzle, at least one passage through said plug through which said metal can flow from said crucible through said passage and through a desired ejection orifice while at least one other orifice is blocked by said plug, and means engaging the upstream side of said plug to move said plug in said nozzle such that metal can flow through said desired orifice while the plug is blocking said at least one other orifice.

2. An apparatus for jet casing molten metal comprising a crucible for retaining said metal, a nozzle at the base of said crucible having a right frustoconical interior shape and a plurality of ejection orifices through its bottom, a plug which is shaped to seal with and rotates in the interior of said nozzle, at least one passage through said plug through which said metal can flow from said crucible through said passage and through a desired ejection orifice while at least one other orifice is blocked by said plug, and means engaging the upstream side of said plug to rotate said plug in said nozzle such that metal can flow through said desired orifice while the plug is blocking said at least one other orifice.

3. An apparatus for jet casting molten metal comprising a crucible for retaining said metal, a nozzle at the base of said crucible having a right frustoconical interior shape and a plurality of ejection orifices through its bottom, a plug which is shaped to seal with and rotate in the interior of said nozzle, at least one passage through said plug through which said metal can flow from said crucible through said passage and through a desired ejection orifice while at least one other orifice is blocked by said plug, a hole in said plug sealed to a hollow conduit located such that pressurized gas or liquid can be pressed therethrough to clean out said desired orifice if it becomes plugged, and means to rotate said plug in said nozzle from the upstream side of the plug such that it can be positioned to permit metal flow through said desired orifice while blocking said at least one other orifice.

* * * * *